US005866530A

United States Patent [19]

Schmid et al.

[11] Patent Number: 5,866,530

[45] Date of Patent: Feb. 2, 1999

[54] NON-AQUEOUS LIQUID MIXTURES OF ALKYL POLYGLYCOSIDE AND ALKYL POLYALKYLENE GLYCOL ETHER USEFUL IN VARIOUS DETERGENT APPLICATIONS

[75] Inventors: Karl Heinz Schmid, Mettmann; Michael Neuss, Cologne, both of Germany

[73] Assignee: Henkel Kommanditgesellschaft auf Aktien, Duesseldorf, Germany

[21] Appl. No.: 755,997

[22] Filed: Nov. 25, 1996

Related U.S. Application Data

[60] Provisional application No. 60/013,763 Mar. 20, 1996.

[30] Foreign Application Priority Data

Nov. 25, 1995 [DE] Germany ..... 195 43 990.2

[51] Int. Cl.[6] ..... C11D 11/00; C11D 1/83; C11D 3/22; C11D 17/00

[52] U.S. Cl. ..... 510/438; 510/228; 510/351; 510/356; 510/360; 510/413; 510/470; 510/497; 510/506; 510/535; 510/536

[58] Field of Search ..... 510/470, 413, 510/421, 422, 535, 506, 438, 443, 444, 445, 451, 452, 456, 457, 497, 351, 356, 360, 349, 228, 536; 252/239

[56] References Cited

U.S. PATENT DOCUMENTS

| | | | |
|---|---|---|---|
| 4,675,127 | 6/1987 | Kickle et al. | 510/452 |
| 4,889,925 | 12/1989 | Schmid et al. | 536/18.6 |
| 4,898,621 | 2/1990 | Pruehs et al. | 134/25.2 |
| 5,118,439 | 6/1992 | Urfer et al. | 510/418 |
| 5,431,780 | 7/1995 | Raehse et al. | 159/48.1 |
| 5,476,610 | 12/1995 | Schmid et al. | 510/532 |
| 5,544,427 | 8/1996 | Raehse et al. | 34/372 |
| 5,599,787 | 2/1997 | Schmid et al. | 510/535 |
| 5,602,093 | 2/1997 | Haerer et al. | 510/514 |

FOREIGN PATENT DOCUMENTS

| | | |
|---|---|---|
| 075 995 | 4/1983 | European Pat. Off. . |
| 075 996 | 4/1983 | European Pat. Off. . |
| 301 298 | 2/1989 | European Pat. Off. . |
| 317 614 | 5/1989 | European Pat. Off. . |
| 408 965 | 1/1991 | European Pat. Off. . |
| 490 040 | 6/1992 | European Pat. Off. . |
| 542 801 | 5/1993 | European Pat. Off. . |
| 40 30 688 | 4/1992 | Germany . |
| 42 04 035 | 8/1993 | Germany . |
| 42 04 090 | 8/1993 | Germany . |
| 42 06 050 | 9/1993 | Germany . |
| 42 06 495 | 9/1993 | Germany . |
| 43 03 176 | 8/1994 | Germany . |
| 43 03 211 | 8/1994 | Germany . |
| 42 06 521 | 9/1996 | Germany . |
| WO 88/09369 | 12/1988 | WIPO . |
| WO 90/03977 | 4/1991 | WIPO . |
| WO 91/14760 | 10/1991 | WIPO . |
| WO 92/02604 | 2/1992 | WIPO . |

*Primary Examiner*—Ardith Hertzog
*Attorney, Agent, or Firm*—Wayne C. Jaeschke; John E. Drach; Steven J. Trzaska

[57] ABSTRACT

Liquid compounds useful as laundry detergents, dishwashing detergents and cleaning formulations are made by mixing (a) an alkyl and/or alkenyl oligoglycoside and (b) an alkyl polyalkylene glycol ether in the absence of water in a weight ratio of (a) to (b) of 10:90 to 90:10.

6 Claims, No Drawings

NON-AQUEOUS LIQUID MIXTURES OF ALKYL POLYGLYCOSIDE AND ALKYL POLYALKYLENE GLYCOL ETHER USEFUL IN VARIOUS DETERGENT APPLICATIONS

BENEFIT OF EARLIER FILING DATE UNDER 37 CFR 1.78(A)(4)

This application claims the benefit of earlier filed and copending provisional application Ser. No. 60/013,763 filed on Mar. 20, 1996.

BACKGROUND OF THE INVENTION

1. Field of the Invention

This invention relates to liquid, water-free compounds for the production of laundry detergents, dishwashing detergents and cleaning formulations containing glycosides and nonionic surfactants, to the use of these compounds for the production of surface-active formulations and to a process for the production of solid detergents using the liquid compounds.

2. Description of the Related Art

Alkyl oligoglucosides are nonionic surfactants which are acquiring increasing significance by virtue of their excellent performance properties and their particularly advantageous ecotoxicological properties. By virtue of their foaming power, which is comparable with that of anionic surfactants, not only are they suitable for manual dishwashing detergents and hair shampoos, they are also of interest for use in the detergents field. The fact that alkyl oligoglucosides have hitherto been used almost without exception for liquid applications is attributable to the fact that glucosides on the one hand have a high melting range and, on the other hand, can be decomposed during the spray drying of water-containing surfactant slurries typically applied to powder-form products because the sugar structure of the surfactants does not allow temperatures above 120° C. to be applied. Although it is of course possible subsequently to add alkyl oligoglucosides together with other temperature-labile detergent ingredients, for example perfume oils, enzymes and the like, to the tower powder, this has not proved to an economical option in the past.

In addition to the production of washing powders in spray drying towers, where hot drying gases are passed through the tower in countercurrent to the liquid compounds trickling down the tower in the form of fine droplets, recent years have seen the establishment of processes in which a liquid compound is sprayed onto a solid support and at the same time dried and granulated, for example in a mixer or in a fluidized bed. Although these processes operate at distinctly lower temperatures and thus basically enable alkyl oligoglucosides to be used, there is the problem that, even at temperatures in the range from 40° to 60° C., the glucosides are present as cutting-resistant pastes both in the form of their water-containing pastes and in the form of mixtures of those pastes with otherwise liquid nonionic surfactants typically used for detergent purposes. However, since liquid compounds are required for the granulation processes mentioned above, the mixtures would have to be melted and constantly heated before each use which would not only involve considerable outlay on equipment, it would also be uneconomical. Accordingly, the problem addressed by the present invention was to remedy this unfavorable situation.

Description of the Invention

The present invention relates to liquid compounds for laundry detergents, dishwashing detergents and cleaning formulations which are obtained by mixing (a) alkyl and/or alkenyl oligoglycosides and (b) alkyl polyalkylene glycol ethers in the absence of water in a ratio by weight of (a) to (b) of 10:90 to 90:10 and preferably 30:70 to 70:30.

It has surprisingly been found that the mixtures according to the invention are at least flowable and generally liquid or even low in viscosity at temperatures of only 40° C. Flowable products are even obtained when the glycoside content is increased to 90% by weight or highly ethoxylated nonionic surfactants are used. The invention includes the observation that mixing of the water-free components has distinct advantages over the subsequent removal of water from the mixtures. The mixtures may readily be used, for example, in granulation processes for the production of detergents.

Alkyl and/or alkenyl oligoglycosides

Alkyl and alkenyl oligoglycosides are known nonionic surfactants corresponding to formula (I):

$$R^1O\text{-}[G]_p \qquad (I)$$

in which $R^1$ is an alkyl and/or alkenyl radical containing 4 to 22 carbon atoms, G is a sugar unit containing 5 or 6 carbon atoms and p is a number of 1 to 10. They may be obtained by the relevant methods of preparative organic chemistry. EP-A1 0 301 298 and WO 90/03977 are cited as representative of the extensive literature available on the subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (I) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view.

The alkyl or alkenyl radical $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred.

In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred.

Alkyl polyethylene glycol ethers

Alkyl polyalkylene glycol ethers, i.e. alkyl polyethylene and/or polypropylene glycol ethers, which are suitable as component (b), correspond to formula (II):

$$R^2O\,(CH_2CH_2O)_n\,(CH_2\overset{\overset{CH_3}{|}}{C}HO)_mR^3 \qquad (II)$$

in which $R^2$ is a linear or branched, aliphatic alkyl and/or alkenyl radical containing 6 to 22 carbon atoms, $R^3$ is hydrogen or an n-butyl radical, n is a number of 1 to 20 and m is 0 or a number of 1 to 20. They are known nonionic surfactants which are industrially obtained by acid-catalyzed or preferably base-catalyzed addition of ethylene oxide and/or propylene oxide onto primary alcohols. Depending on the catalyst, the polyglycol ethers may have a conventionally broad homolog distribution or even a narrow-range homolog distribution.

Typical examples are the adducts of, on average, 1 to 20 moles and preferably 3 to 10 moles of ethylene oxide and/or propylene oxide with 1 mole of the following alcohols: caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol and the technical mixtures thereof obtained, for example, in the high-pressure hydrogenation of technical methyl esters based on fats and oils or aldehydes from Roelen's oxosynthesis and as monomer fraction in the dimerization of unsaturated fatty alcohols. Adducts of, on average, 3 to 10 moles of ethylene oxide with technical $C_{12-18}$ fatty alcohols, for example coconut oil, palm oil, palm kernel oil or tallow fatty alcohol, are referred. In addition, the polyglycol ethers may be end-capped by an n-butyl group.

Aqueous mixtures of alkyl oligoglucosides and fatty alcohol polyglycol ethers are known from the prior art, cf. EP-B 0 075 995 (Procter & Gamble), EP-B 0 075 996 (Procter & Gamble), EP-A 0 317 614 (Staley), EP-B 0 408 965 (Kao), WO 91/14760 (Henkel), EP-B 0 542 801 (Henkel) and EP-A 0 490 040 (Hüls).

Production of the compounds

The liquid water-free compounds according to the invention are produced simply by mixing the raw materials, optionally at temperatures in the range from 30° to 50° C. A preferred embodiment of the invention is characterized by the use as alkyl oligoglucosides of the technical water-free products obtained immediately after the removal of free fatty alcohol in the acid-catalyzed acetalization of glucose with excess alcohol. The crude alkyl oligoglucosides, which are directly removed from the falling-film or thin-layer evaporator, may have a content of fatty alcohol, generally cocofatty alcohol, of 0.1 to 10% by weight and preferably 0.5 to 1% by weight which does not interfere with their subsequent application.

Commercial Applications

The compounds according to the invention are water-free, but are still at least flowable and pumpable over a broad mole fraction range, even at low temperatures and high glycoside contents and where highly ethoxylated nonionic surfactants are used. They are suitable for the production of surface-active formulations, for example laundry detergents, dishwashing detergents and cleaning formulations, in which they may be present in quantities of 1 to 50% by weight and preferably 5 to 35% by weight.

Although the compounds are of course also suitable for the production of liquid concentrates, for example liquid detergents or manual dishwashing detergents, a key feature of the invention is to use their favorable rheology for the production of solid, preferably granulated detergents. Accordingly, the present invention also relates to a process for the production of solid detergents, in which the liquid compounds are mixed together with other detergent ingredients, preferably fatty alcohol sulfates, and—in a following step—are simultaneously dried and converted into particulate form. Corresponding processes are described in more detail hereinafter:

Mixing

One particularly simple embodiment of the process for the production of detergents comprises initially introducing an anionic surfactant in powder form and thoroughly mixing it with the necessary quantity of liquid compounds according to the invention. Such machines as, for example, Lödige paddle mixers or, more particularly, Schugi spray mixers, in which the anionic surfactant is introduced into the mixing chamber and sprayed with the liquid compounds, may be used with advantage for this embodiment of the process. Drying of the anionic surfactant pastes and mixing may also be carried out simultaneously in a fluidized-bed dryer. Dry readily soluble powders are obtained and, if necessary, may be impregnated with other typical detergent additives and processed, for example to detergent extrudates.

SKET granulation

Another possibility is to subject the anionic surfactants to so-called SKET granulation. SKET granulation is understood to be granulation and simultaneous drying preferably carried out in batches or continuously in a fluidized bed. To this end, water-containing pastes of anionic surfactants and the liquid compounds may be introduced simultaneously or successively into the fluidized bed through one or more nozzles. Preferred fluidized-bed arrangements have base plates measuring 0.4 to 5 m. The SKET granulation is preferably carried out at fluidizing air flow rates of 1 to 8 m/s. The granules are preferably discharged from the fluidized bed via a sizing stage. Sizing may be carried out, for example, by means of a sieve or by an airstream flowing in countercurrent (sizing air) which is controlled in such a way that only particles beyond a certain size are removed from the fluidized bed why smaller particles are retained in the fluidized bed. The inflowing air is normally made up of the heated or unheated sizing air and the heated bottom air. The temperature of the bottom air is between 80 and 400° C. and preferably between 90 and 350° C. A starting material, for example SKET granules from an earlier test batch, is advantageously introduced at the beginning of the SKET granulation process. The water from the anionic surfactant paste evaporates in the fluidized bed, resulting in the formulation of partly dried to fully dried nuclei which are coated with further quantities of anionic surfactant and the liquid compound, granulated and again simultaneously dried. Reference is made in this connection to the teaching of German patent applications DE-A1 43 03 211 and DE-A1 43 03 176, of which the disclosures are hereby specifically included as part of the disclosure of the present application.

Extrusion

In one particular embodiment of the invention, anionic surfactants in powder form are mixed with the liquid compounds according to the invention and the resulting mixture is homogenized and solidified in a screw extruder. The mixture is extruded through a multiple-bore die, resulting in the formation of strands which may be mechanically size-reduced in known manner to extrudates or needles of the required shape and size. Extrudates of this type have a particularly high dissolving rate and show very favorable dispensing behavior in washing machines.

Drying with superheated steam

In another process for the production of solid detergents, the liquid compounds are dried together with water-containing surfactant pastes and optionally carrier salts in the absence of atmospheric oxygen and in the presence of superheated steam. The principle behind this process is disclosed by applicants in their German patent applications DE-A1 40 30 688, DE-A1 42 04 035, DE 42 04 090, DE-A1 42 06 050, DE-A1 42 06 495 and DE-A1 42 06 521. The process is based on the principle that, through condensation of the superheated steam on the cooler starting material and the transfer of the heat of condensation to the material to be dried, the water-containing droplets are spontaneously heated to the boiling temperature of water under the working conditions, i.e. to temperatures of around 100° C. at normal pressure. This boiling temperature is maintained as the minimum temperature throughout the residence time in the droplets. Steam-volatile impurities, for example fatty alcohols or formic acid, which cannot be removed by distillation under typical conditions or can only be removed under drastic conditions and with significant outlay on equipment, are removed rapidly, completely and non-destructively with the water phase in this way. In one preferred embodiment of the process according to the invention, the mixtures are sprayed into a closed-circuit system together with superheated steam at a temperature in the range from 120° to 280° C., the water of condensation is removed with the impurities dissolved therein and the dried and purified useful materials are removed from the circuit.

Basically, the closed-circuit system is operated with circulating steam from which the water evaporated from the starting material is removed while the energy released is returned to the circulating steam. Whereas, in conventional processes, operation at relatively high temperatures always involves the danger of partial carbonization of the material to be purified, the absence of atmospheric oxygen in the present case readily enables working temperatures of, in particular, 150° to 200° C. to be applied. After removal of the dissolved impurities, the steam removed may advantageously be put to another use as process steam.

Flash dryer

The simultaneous drying and granulation process may also be carried out in a horizontally arranged thin-layer evaporator with rotating fittings, for example of the type marketed under the name of "Flash Dryer" by the VRV company. In simple terms, a flash dryer is a tube which can be heated to different temperatures over several zones. Through one or more shafts, which are fitted with vanes or plowshares as rotating fittings, the paste-form starting material which is introduced by a pump is projected against the heated walls on which drying takes place in the form of a thin layer, typically with a thickness of 1 to 10 mm. It has proved to be of advantage in this regard to apply a temperature gradient of 170 (product inlet) to 20° C. (product outlet) to the thin-layer evaporator. This may be done, for example, by heating the first two zones of the evaporator to 160° C. and cooling the last zone to 20° C. Higher drying temperatures have not proved to be of advantage in view of the thermal lability of the starting materials. The thin-layer evaporator is operated under atmospheric pressure, air being passed through in countercurrent (throughput 50 to 150 $m^3/h$). The gas entry temperature is generally in the range from 20° to 30° C. while the exit temperature is in the range from 90° to 110° C.

Other ingredients

The optionally granulated detergents produced from the compounds according to the invention may contain as their most important components other surfactants, preferably anionic surfactants, soaps, inorganic builders, such as phosphates, zeolites, crystalline layer silicates, amorphous silicates, compounds of amorphous silicates and carbonates, organic co-builders, bleaching agents and bleach activators, foam inhibitors, enzymes, optical brighteners, soil repellents and redeposition inhibitors. Granular detergents containing anionic surfactants of the fatty alcohol sulfate type as further components are particularly preferred. These anionic surfactants may advantageously be based on $C_{12/14}$ cocoalcohols and/or $C_{16/18}$ tallow alcohols, the ratio by weight between these two components being in the range from 90:10 to 10:90 and, typically, 20:80, 30:70, 40:60 or 50:50. The detergent granules may have both a low content and also a high content of surfactants, for example a content of 5 to 50% by weight of fatty alcohol sulfates and 5 to 50% by weight of the compounds according to the invention. Another advantage of the granules is that they are non-tacky and have high apparent densities of 300 to 1200 g/l and preferably in the range from 500 to 800 g/l.

EXAMPLES

Surfactants used

A1) $C_{12/16}$ cocoalkyl oligoglucoside, water-free

A2) Aqueous $C_{12/16}$ cocoalkyl oligoglucoside paste, around 50% by weight

B1) $C_{12/14}$ cocofatty alcohol+3EO adduct

B2) $C_{12/18}$ cocofatty alcohol+7EO adduct

B3) Octanol+10 EO adduct

Mixtures of alkyl glucosides and polyethylene glycol ethers were prepared at room temperature and the consistency of the products was determined at temperatures in the range from 40° to 70° C. In the case of Comparison Example C3, a mixture of a water-containing glucoside paste and a nonionic surfactant was subsequently freed from water. The results are set out in Table 1 below. The quantities shown represent percentages by weight and are based on the starting materials including the water content, if any.

TABLE 1

Mixtures of alkyl oligogluaasides and alkyl polyethylene glycol ethers

| | | | | Consistenay at | | | |
|---|---|---|---|---|---|---|---|
| Example | A | B | A:B | 40° C. | 50° C. | 60° C. | 70° C. |
| 1 | A1 | B1 | 50:50 | Liquid | Thinly liquid | Thinly liquid | Thinly liquid |
| 2 | A1 | B2 | 50:50 | Pasty | Liquid | Thinly liquid | Thinly liquid |
| 3 | A1 | B2 | 70:30 | Pasty | Liquid | Liquid | Liquid |
| 4 | A1 | B2 | 80:20 | Pasty | Pasty | Liquid | Liquid |

TABLE 1-continued

Mixtures of alkyl oligogluaasides and alkyl polyethylene glycol ethers

| Example | A | B | A:B | Consistenay at 40° C. | 50° C. | 60° C. | 70° C. |
|---|---|---|---|---|---|---|---|
| 5 | A1 | B2 | 90:10 | Pasty | Pasty | Pasty | Pasty |
| 6 | A1 | B3 | 50:50 | Pasty | Liquid | Liquid | Thinly liquid |
| C1 | A2 | B1 | 50:50 | Solid | Solid | Pasty | Pasty |
| C2 | A2 | B2 | 50:50 | Gel-like | Thickly liquid | Thickly liquid | Liquid |
| C3* | A1 | B2 | 50:50 | Pasty | Pasty | Liquid | Thinly liquid |

What is claimed is:

1. A process for making a particulate-form compound useful as a laundry detergent, dishwashing detergent and a cleaning formulation comprising mixing (a) an alkyl and/or alkenyl oligolycoside and (b) an alkyl polyalkylene glycol ether in the absence of water in a weight ratio of (a) to (b) of 10:90 to 90:10, to form a liquid compound and then drying the liquid compound to form a particulate-form compound.

2. The process of claim 1 wherein said alkyl and/or alkenyl oligoglycoside is a compound of the formula (I):

$$R^1O—[G]_p \quad (I)$$

wherein $R^1$ is an alkyl and/or alkenyl radical having from 4 to 22 carbon atoms, G is a sugar unit containing 5 or 6 carbon atoms and p is a number of 1 to 10.

3. The process of claim 1 wherein said alkyl polyalkylene glycol ether is a compound of the formula (II):

$$R^2O\,(CH_2CH_2O)_n\,(CH_2\overset{\overset{CH_3}{|}}{C}HO)_mR^3 \quad (II)$$

wherein $R^2$ is a linear or branched, aliphatic alkyl and/or alkenyl radical having from 6 to 22 carbon atoms, $R^3$ is hydrogen or an n-butyl radical, n is a number from 1 to 20 and m is 0 or a number of 1 to 20.

4. The process of claim 1 wherein said weight ratio is from about 30:70 to about 70:30.

5. A process for making a granulated compound useful as a laundry detergent, dishwashing detergent and a cleaning formulation comprising the steps of: (1) forming a liquid mixture by mixing (a) an alkyl and/or alkenyl oligoglycoside and (b) an alkyl polyalkylene glycol ether in the absence of water in a weight ratio of (a) to (b) of 10:90 to 90:10; (2) simultaneously drying and adding a fatty alcohol sulfate to said liquid mixture to form said granulated compound.

6. The process of claim 5 wherein step (2) is accomplished in a mixer or a fluidized bed.

* * * * *